166-274 SR
2/24/81 XR 4,252,191

United States Patent [19]
Pusch et al.
[11] 4,252,191
[45] Feb. 24, 1981

[54] METHOD OF RECOVERING PETROLEUM AND BITUMEN FROM SUBTERRANEAN RESERVOIRS

[75] Inventors: Günter Pusch, Celle; Karl-Heinz Gaida, Wietze, both of Fed. Rep. of Germany

[73] Assignee: Deutsche Texaco Aktiengesellschaft, Hamburg, Fed. Rep. of Germany

[21] Appl. No.: 103,304

[22] Filed: Dec. 13, 1979

Related U.S. Application Data

[63] Continuation-in-part of Ser. No. 918,246, Jun. 23, 1978, abandoned, which is a continuation of Ser. No. 785,793, Apr. 8, 1977, abandoned.

[30] Foreign Application Priority Data

Apr. 10, 1976 [DE] Fed. Rep. of Germany ..... 2615874

[51] Int. Cl.[3] ..... E21B 43/243; E21B 43/20
[52] U.S. Cl. ..... 166/261; 166/272; 166/273; 166/274
[58] Field of Search ..... 166/261, 272, 274, 256, 166/273

*Primary Examiner*—James A. Leppink
*Assistant Examiner*—George A. Suchfield
*Attorney, Agent, or Firm*—Carl G. Ries; Robert A. Kulason; Charles L. Bauer

[57] ABSTRACT

A method of recovering petroleum from an underground reservoir by employing an in-situ combustion at a pressure of at least 120 bar by the simultaneous injection of oxygen and water whereby the temperature is controlled in the range of 450°-550° C.

7 Claims, 5 Drawing Figures

"SLIM TUBE" TEST
"$CO_2$-MISCIBLE-DISPLACEMENT"
INFLUENCE OF THE SLUG DIMENSION OF THE INTERMEDIATE COMPONENTS ($C_4$-$C_{20}$) IN CRUDE OIL UPON THE EXTRACTION FACTOR

METHOD OF RECOVERING PETROLEUM AND BITUMEN FROM SUBTERRANEAN RESERVOIRS

This application is a continuation-in-part of Ser. No. 918,246, filed June 23, 1978 now abandoned, which in turn is a Continuation of Ser. No. 785,793, filed Apr. 8, 1977, now abandoned.

FIELD OF THE INVENTION

This invention relates to a method for recovering petroleum from a subterranean hydrocarbon-bearing reservoir employing in-situ combustion by the injection of oxygen and water.

DESCRIPTION OF THE PRIOR ART

In the field of petroleum recovery from underground reservoirs, carbon dioxide flooding methods are well-known, wherein the carbon dioxide is injected into the reservoir from above ground level. There are also known methods of recovering petroleum and bitumen from underground reservoirs wherein carbon dioxide is dissolved in the hydrocarbon in the reservoir and this hydrocarbon containing the carbon dioxide is forced towards the production well by injecting a liquid and/or gaseous flushing media. The carbon dioxide is generated in-situ by burning out a portion of the underground petroleum wherein the pressure in the reservoir is increased and the oxygen necessary for the combustion is conveyed to the zone of combustion in a superatmospheric concentration such that a partial pressure of the available carbon dioxide is between 60 and 90 bar. The generated carbon dioxide is displaced toward the production well bore by water injected under pressure. The advantage of this known method lay in the ability to raise the extraction rate to near 60% of the oil originally present in the reservoir. As compared with the known water flooding methods this method signified an improvement of about 10% in the extraction rate. The volume expansion and the viscosity reduction by the carbon dioxide dissolved in the petroleum were regarded as the principal extraction mechanisms.

In U.S. Pat. No. 3,174,543 there is disclosed a recovery process in which a gaseous phase is developed, the main portion of which is carbon dioxide, by the in-situ combustion of native reservoir materials with oxygen. In this method, oxygen is forced into the reservoir, and a combustion front is established around the injection bore. This combustion front is propagated over a definite distance away from the injection well and thereafter the air flow is terminated and the pressure within the injection well is reduced to permit backflow. Because of the heat created by this combustion, distillation and cracking processes occur in the reservoir. The intermediate hydrocarbon components of the oil deposit thus produced are backflowed to the injection well. Backflow is continued until the less viscous hydrocarbons appear in the injection well.

The backflow operation has the effect that the heavy hydrocarbon components of the oil deposit are cracked in this strongly heated zone of the reservoir, in which the oil had previously been burned. After the first intermediate components, i.e. less viscous hydrocarbons appear in the injection well, combustion is reinitiated. Thus, this method involves a cyclic process. The second combustion is intended to generate the thermal drive and to develop a miscible gas phase. A disadvantage of this method is that in the first combustion phase with almost pure oxygen, such high temperatures are reached that the reservoir matrix sinters. At these high temperatures not only are all the hydrocarbon components consumed in the region of the combustion front, but the permeability of the reservoir is also seriously damaged. The heat matrix is used to promote the cracking of the hydrocarbons as backflow takes place. In this method, therefore, a stationary generator, i.e., a heat chamber, is used. In the backflow operation a large proportion of the formed intermediate hydrocarbon components are burned in the overheat rock.

In U.S. Pat. No. 3,126,957 there is disclosed a carbon dioxide-hydrocarbon-miscible method for recovering residues from hydrocarbon-bearing reservoirs. Again in this method the heat generator is stationary. In this method there is no backflow of the oil contained in the deposit, but additional crude oil is supplied to the reservoir. The intermediate components which are necessary to bring about miscible flooding, are produced from the additional crude oil. Again in this method a high temperature zone is produced by means of an oxygen-containing gas.

Since this method also involves the use of a stationary heat generator, the capacity for forming intermediate hydrocarbons is limited. By adopting a discontinuous mode of operation, i.e. by stagewise enrichment of intermediate hydrocarbons, this disadvantage is sought to be compensated.

Besides the availability of suitable pressure, an important condition for the use of carbon dioxide for oil recovery is the particular composition of the oil in the reservoir. In order to make carbon dioxide treatment effective, the oil in the reservoir must be as rich as possible in $C_4$–$C_{20}$ components (intermediate hydrocarbons). These components must be present in the oil in the formation in a quantity of about 60 up to 90% by volume. If this condition is fulfilled it is possible for the carbon dioxide to extract from the oil these components contained in it, to feed these components into a zone situated between the oil bank and the following injected water, and in this way to form a transition zone, which is miscible both with the oil as well as with the following water saturated with carbon dioxide. However, since these conditions only occur in a few reservoirs, it is not possible generally to adopt normal carbon dioxide flooding.

It is the object of the present invention to provide a method for oil recovery wherein the well-known extraction capability of the carbon dioxide can be effectively utilized and is not restricted to subterranean petroleum reservoirs that contain crude oil including the intermediate hydrocarbon components in the proportions adequate for the purpose above described. Moreover, the disadvantage of the stationary heat generator in having a limited capacity for forming the intermediate components is to be compensated by other means than by the adoption of cyclic enrichment.

DESCRIPTION OF THE PREFERRED EMBODIMENT

According to the invention there is provided a method for recovering petroleum having a gravity in the range of about 20° to about 45° API, preferably in the range of 25°–30° API, from a subterranean reservoir by the use of underground combustion with substantially pure oxygen. The reservoir is traversed by at least one injection well and at least one production well. A combustion front is first established in the reservoir by initiating a partial underground combustion. By partial underground combustion is meant to be the combustion of the residual oil in a reservoir which has undergone a change by thermal drive mechanisms. Prior to the initiation of the in-situ combustion the reservoir pressure should be at least 120 bar, dependent upon the pressure at which carbon dioxide is miscible with the reservoir oil. The oxygen-containing gas is introduced under pressure simultaneously with water, which is vaporized in the reservoir matrix and/or in the combustion front. By means of the carbon dioxide generated by the combustion, a carbon dioxide saturated water zone is formed ahead of the front. With the continuing generation of carbon dioxide, extraction is effected both of the intermediate hydrocarbons originally present in the deposit as well as the cracking and distillation products formed from the higher hydrocarbons by the combustion process to form a miscible transition zone between the oil deposit and the carbon dioxide-saturated condensed water vapor. After the combustion front has proceeded to a desired distance the injection of the oxygen gas is terminated, and a water drive is continued whereby the fluids of the reservoir are displaced toward the production well from which they are produced. Because this method operates with a mobile heat generator there is always available an adequate quantity of intermediate hydrocarbon components.

In this method, operation is carried out at a pressure at least of 120 bar, so that the pressure is at least above the minimum miscibility pressure at which carbon dioxide is capable of entering into a miscible transition phase with oil. While it is necessary in conventional underground partial combustion methods to burn out up to $\frac{2}{3}$ of the volume of the oil in the reservoir, it is sufficient in the present invention to consume only one-sixth to one-third of the oil volume so that stable formation of the combustion front is well-controlled. A further advantage of the method lies in the fact that it is even possible to work out reservoirs of about 1 m capacity, while in the other known underground partial combustion methods the smallest possible capacity of the formations which could be worked out was 3–4 m.

Figure 1:
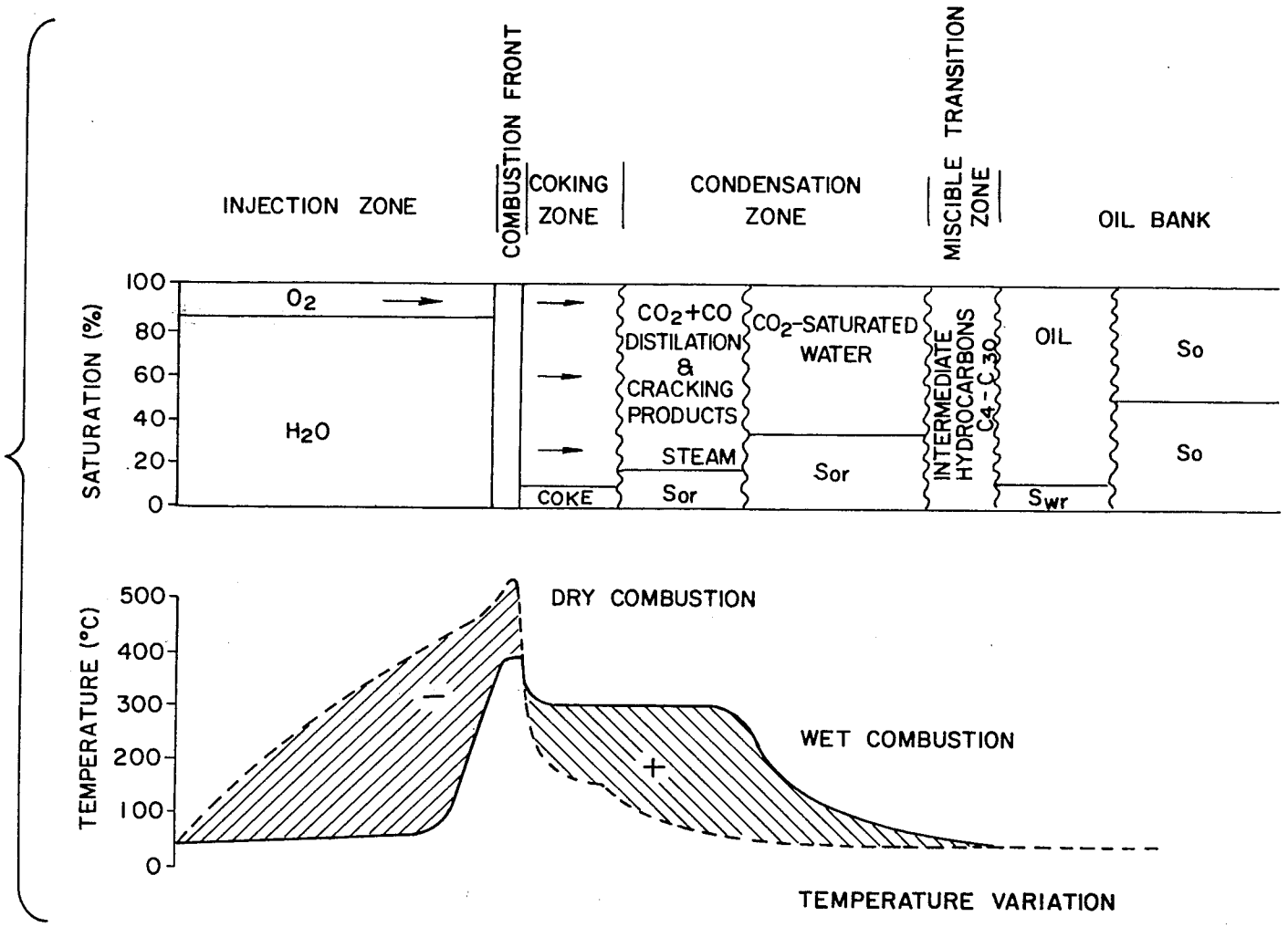
FIG. 1 is a schematic representation of the method cycle and the corresponding temperature curve.

FIG. 1 shows schematically an idealized representation of the individual zones that develop in a reservoir during the progress of the method of invention after in-situ combustion has been initiated together with the corresponding temperatures for the respective zones. The vertical scale (on the upper representation) represents fluid saturations, while the horizontal scale represents the distance from the injection well (not shown). The wavy lines express that there are no distinct boundaries between the individual zones. After ignition, the gas that is substantially pure oxygen and water are injected to move the combustion front in the direction of the production well (not shown). In the immediate vicinity of the injection well the greater part of the pore volume is filled with water. The proportional distribution of water to oxygen may be seen from the saturation. As a result of the combustion of the residual oil present in the reservoir, carbon dioxide and carbon monoxide are formed. Since a high content of carbon dioxide is desirable, the formation is favored by the use of almost pure oxygen (≧96% oxygen), and by controlling the temperature in the range of 450°–550° C. In addition, because of the high temperature and the steam generated in the combustion zone, distillation and cracking products comprising intermediate hydrocarbons are formed and a transition zone of the hydrocarbon components generally in the range of carbon number of 4 to 20 develops behind the oil of the deposit. Behind this zone is formed a carbon dioxide-saturated water zone. The carbon dioxide formed dissolves in water, but even better in hydrocarbons.

When the predetermined extent of an areal burn is attained, the oxygen injection is terminated, but the water injection is continued to provide a water drive for displacement of the reservoir fluids. The transition zone of hydrocarbons, which is miscible with the reservoir oil, banks the oil in the reservoir. The carbon dioxide which diffuses through the miscible zone into the oil bank supports the displacement effect.

Figure 2:
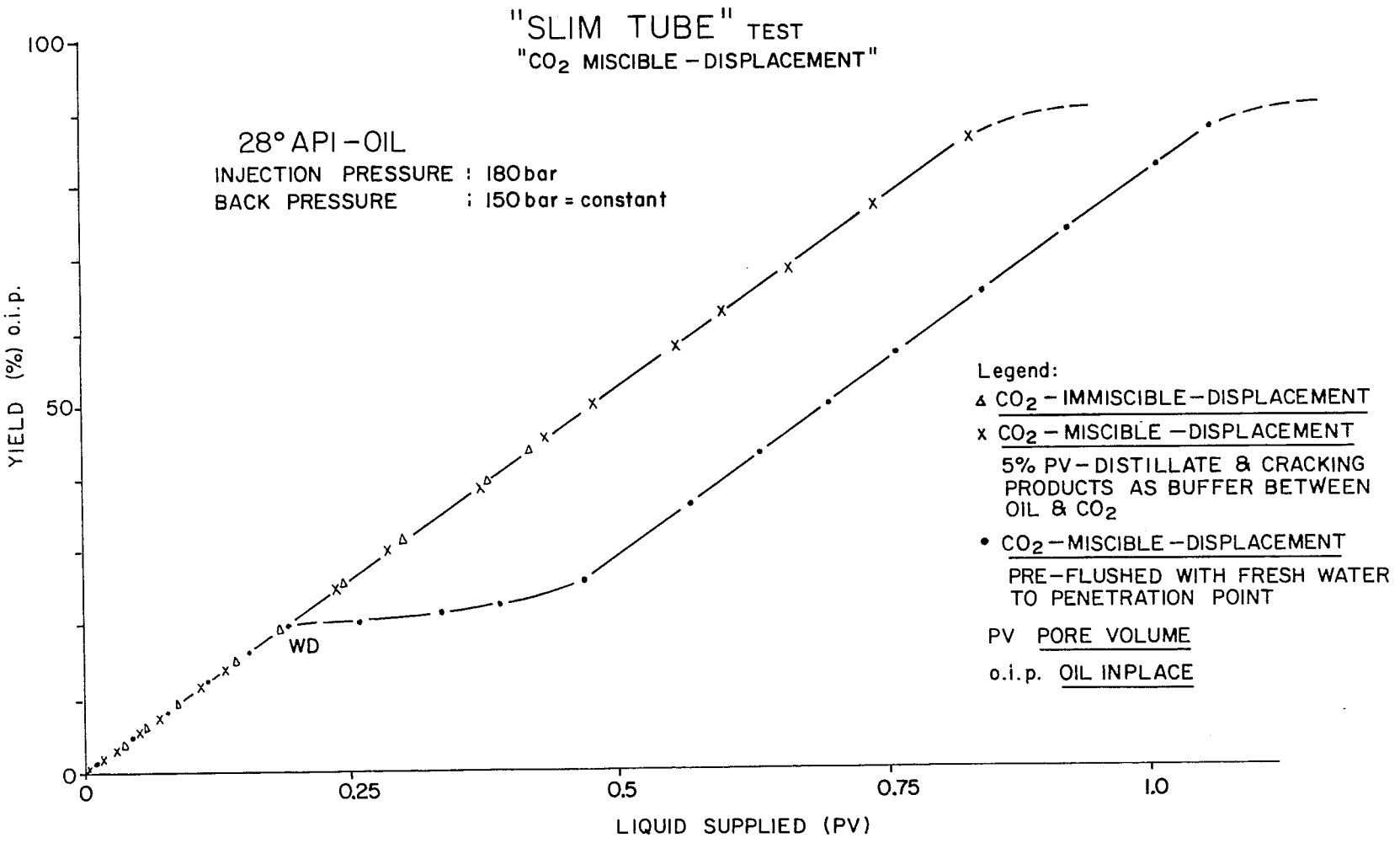
FIG. 2 shows the result of a test for representing the effectiveness of the carbon dioxide flooding methods, wherein a miscible transition zone is formed.

From FIG. 2 may be seen to what extent the oil yield can be increased if the miscible transition zone of intermediate hydrocarbons is formed between the oil and the following carbon dioxide. By means of a buffer zone of distillation products and cracking products, taking up only 5% of the pore volume, a doubling of the oil yield was achieved.

Figure 3:
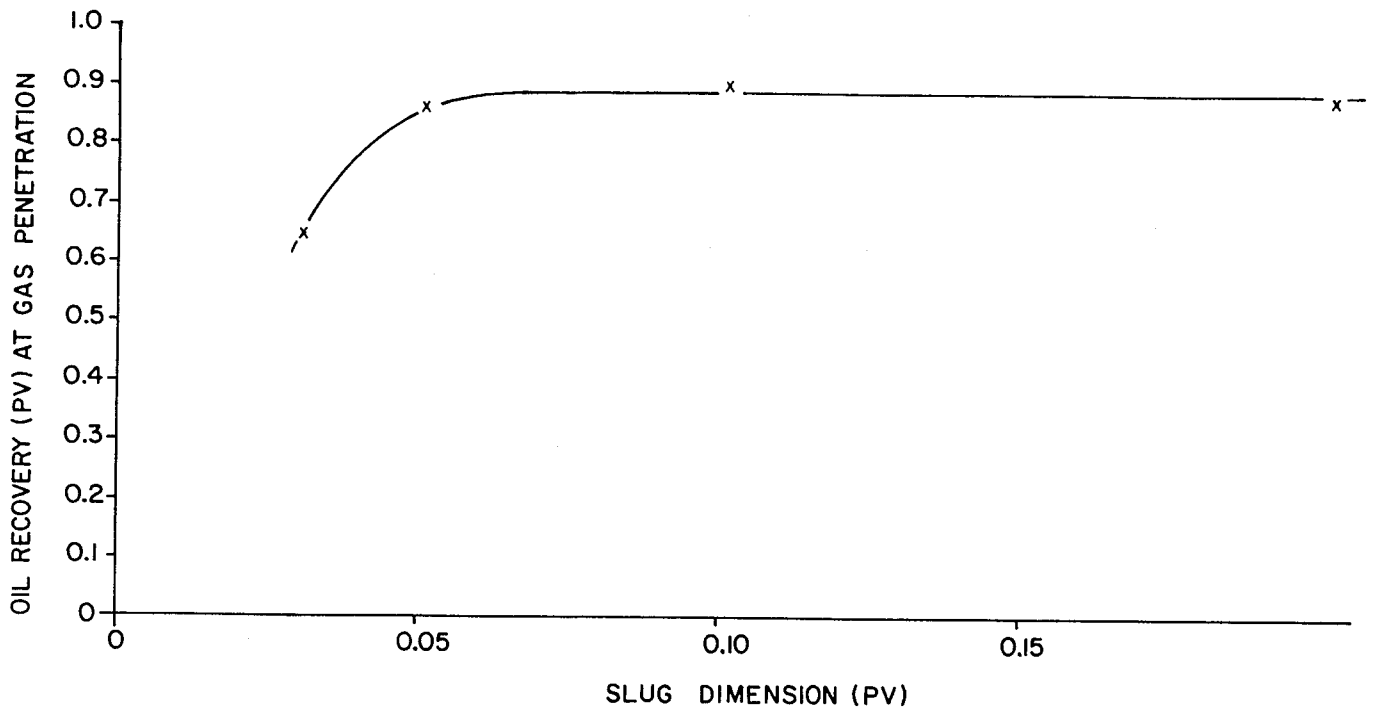
FIG. 3 shows the result of a test showing the influence of the slug dimension of the intermediate components of the crude oil on the extraction rate.

The influence of the slug size of a buffer of intermediate components ($C_4$–$C_{20}$) upon the extraction factor is evident from FIG. 3. Fron this graphic representation it may be seen that the slug dimension (PV) need not be increased above 5% of the pore volume because normally no further increase of the extraction rate takes place. The slug dimension of the buffer takes up between 1–15%, preferably 3–5% of the pore volume.

Figure 4:
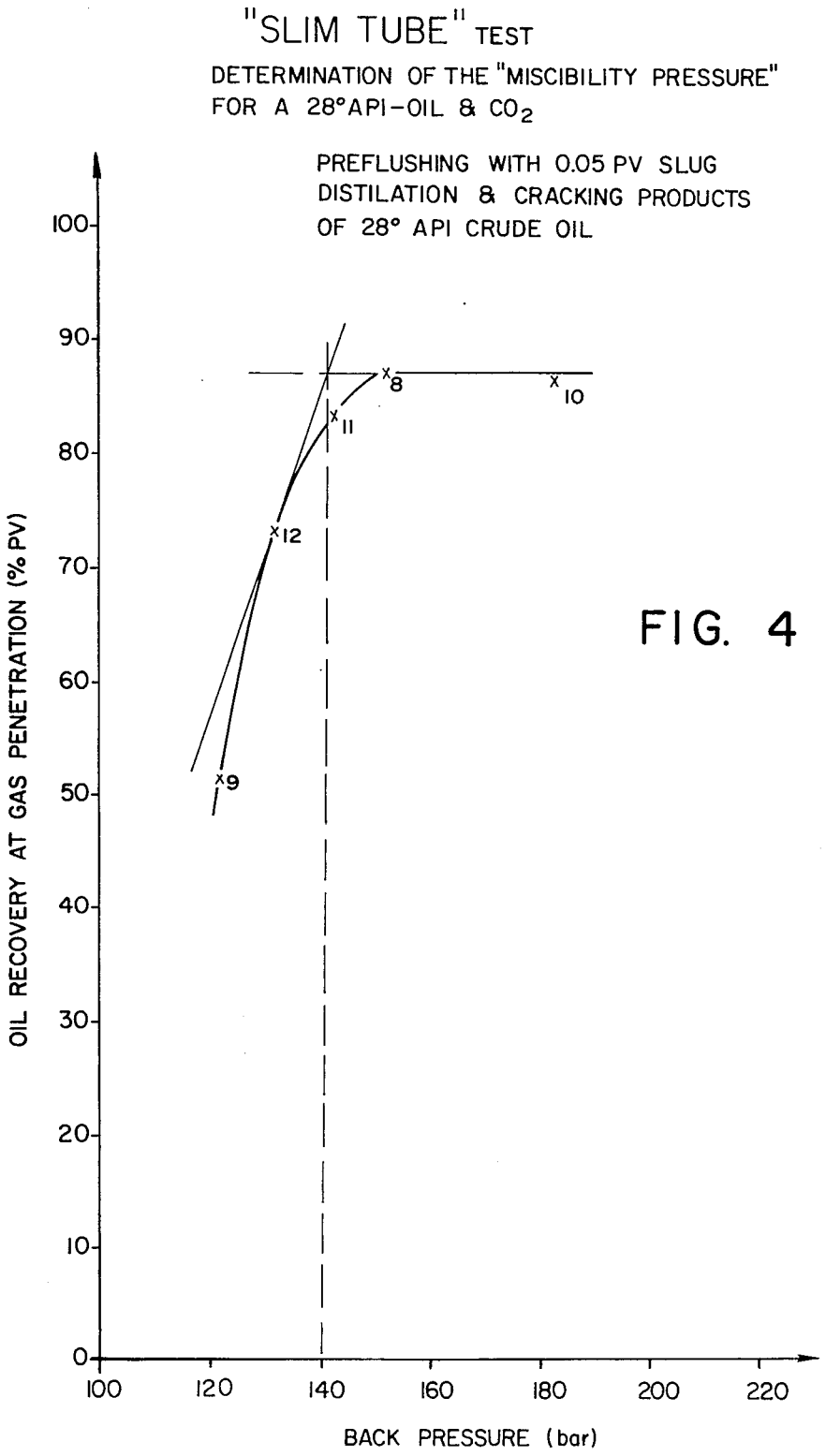
FIG. 4 is a graphic representation for determining the minimum pressure at which miscibility occurs between the oil and the carbon dioxide.

FIG. 4 shows a graph for determining the pressure at which miscibility takes place between oil and carbon dioxide. This pressure is determined for each different situation because it is dependent upon the reservoir depth, upon the oil present in the reservoir, and the petrophysical properties of the strata. The graph relates to the determination of the pressure at which miscibility appears between a 28° API oil and carbon dioxide. Upon the ordinate there is plotted the oil recovery with gas penetration in percentage of the pore volume, and upon the abcissa there is plotted the pressure in the deposit (back pressure). The oil-sand packing (slim tube) adopted as a model for the deposit, was preflushed with a slug of distillation anc cracking products of 28° API crude oil of 5% of the pore volume. Since the curve has no pregnant inflection point, the pressure at which the miscibility appears is, for example, determined by applying tangents to the flanks of the curve, and then dropping perpendiculars from the intersection point of these tangents onto the abcissa and thus defining the desired pressure. This pressure may vary according to the temperature and other conditions existing in the deposit; for the oil which is used, 28° API oil, the pressure lies at about 140–150 bar.

Figure 5:
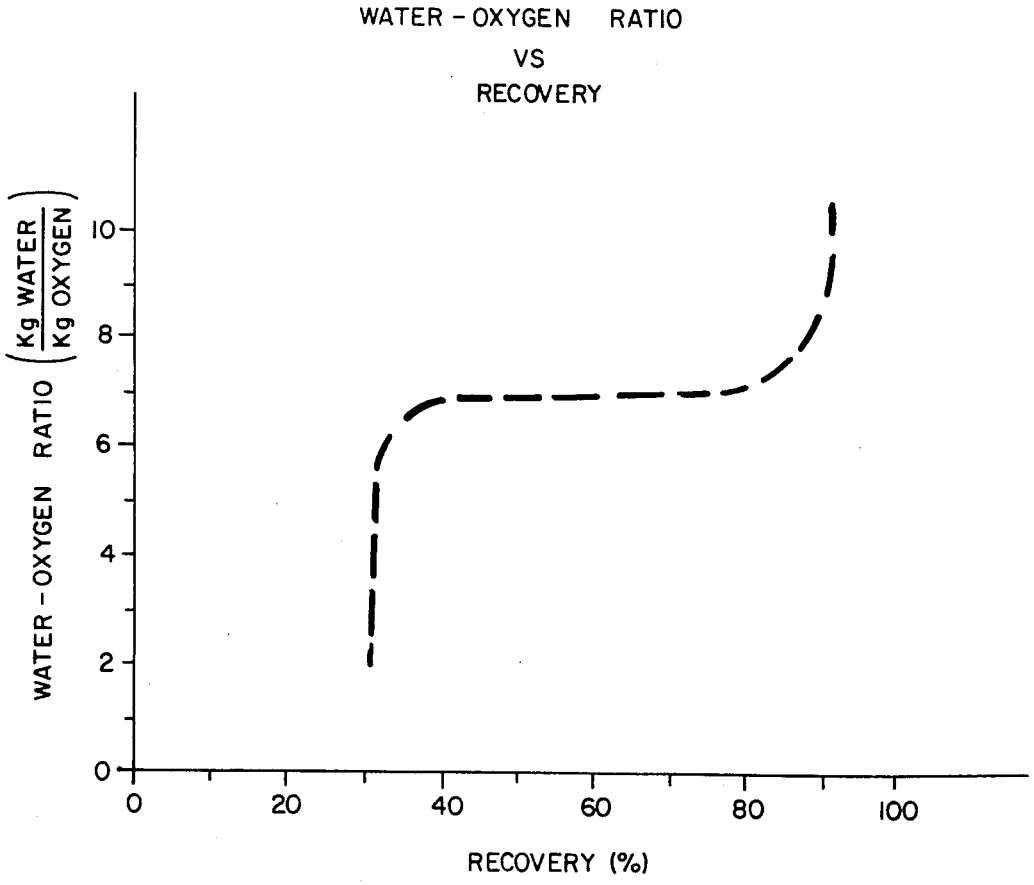
FIG. 5 shows the effect of water-oxygen ratios on recovery.

In FIG. 5 the importance of the water-oxygen ratio is shown on the recovery. Water-oxygen ratio is plotted on the vertical scale. While the water-oxygen ratio (Kg water/Kg oxygen) is important in controlling the temperature and the rate of propagation, it also greatly and unexpectedly enhances oil recovery, as shown in the Figure. It can be seen that the water-oil ratio is almost doubled when the ratio of water to oxygen is in the range of 6.5 to 10.

The method is, surprisingly, just as applicable if preliminary waterflooding is carried out. In a waterflooding test, that was performed in a completely oil saturated sand packing, the water penetration took place after an oil delivery of about 0.25 of the pore volume, i.e. 99% of the subsequently delivered medium consisted of water and only 1% of oil. Thereafter, a buffer of distillation and cracking products was introduced and carbon dioxide was injected. The result was that in this case also it was possible to bank the oil although now only residual oil was available (see FIG. 2).

Thus there has been demonstrated an improved in-situ combustion process for the in-situ recovery of oil from a reservoir at a pressure at least 120 bar wherein the oil has a gravity in the range of 20°–45° API, preferably in the range of 25° to 30° API, comprising the following steps:

(1) initiation of an in-situ combustion to establish a combustion front, (2) injection of substantially pure oxygen and simultaneously therewith water, (3) continuing injection until the combustion front has moved a desired distance through the reservoir whereby a zone of intermediate hydrocarbons is formed, together with a carbon dioxide water-saturated zone, (4) termination of the injection of oxygen and continuing injection of water whereby the reservoir fluids are displaced toward the production well, (5) recovery of said reservoir fluids from the production well.

We claim:

1. A method of recovering petroleum having a gravity in the range of 20°–45° API from an underground reservoir penetrated by at least one injection well and by at least one production well wherein the pressure in said reservoir is at least 120 bar, comprising the steps of:

(a) establishing a combustion front in said reservoir adjacent said injection well by the initiation of a partial in-situ combustion, (b) injecting via said injection well a gas comprising substantially pure oxygen and simultaneously therewith, water wherein the water-to-oxygen ratio is in the range of 6.5 to 10 thereby controlling the temperature in the range of 450° to 550° C., (c) continuing said injection to generate carbon dioxide whereby a carbon dioxide-water saturated zone and a transition zone of intermediate hydrocarbons are formed in said reservoir, (d) terminating injection of said oxygen-containing gas when the said transition zone of intermediate hydrocarbons is between 1 to 15 percent of the pore volume and continuing injection of water to displace said transition zone and said reservoir oil through said reservoir toward said production well, (e) recovering said oil via said production well.

2. The method of claim 1, wherein said transition zone of intermediate hydrocarbons consisting of cracking and distillation products having from 4 to 20 carbon atoms is established in the range of 3 to 5 percent of the pore volume between said reservoir oil and the carbon dioxide-saturated water following thereafter, for the purpose of banking the reservoir oil.

3. The method of claim 1, wherein the concentration of oxygen in the oxygen-containing gas is at least 96 percent.

4. The method of claim 1, wherein the reservoir is pressured to at least 120 bar prior to initiation of in-situ combustion.

5. The method of claim 4, wherein the said pressure is in the range of 120 to 150 bar.

6. The method of claim 1, wherein said reservoir has undergone a preliminary waterflood.

7. In a method for recovering petroleum from an underground reservoir penetrated by at least one injection well and at least one production well by means of in-situ combustion with substantially pure oxygen gas wherein the pressure of said reservoir is greater than 120 bar the improvement comprising the steps of:

(a) after the establishment of said in-situ combustion, injecting via said injection well simultaneously with said gas water wherein the ratio of said water to said oxygen is 6.5 to 10 whereby carbon dioxide is generated to establish a carbon dioxide-saturated water zone ahead of said combustion front, and intermediate hydrocarbons, comprising hydrocarbons initially present in said reservoir and hydrocarbons resulting from cracking and distillation, are formed to establish a transition zone of about 5 percent of the pore volume ahead of said carbon dioxide-saturated water zone, (b) terminating injection of said gas when from one-sixth to one-third of the reservoir has undergone in-situ combustion and thereafter continuing the injection of said water via said injection well to displace said transition zone, and said petroleum toward said production well, (c) recovering said petroleum via said production well.

* * * * *